US005861209A

United States Patent [19]

Haskins et al.

[11] Patent Number: 5,861,209

[45] Date of Patent: Jan. 19, 1999

[54] ARAGONITIC PRECIPITATED CALCIUM CARBONATE PIGMENT FOR COATING ROTOGRAVURE PRINTING PAPERS

[75] Inventors: William John Haskins, Bethlehem; Edward Joseph Osterhuber, Riegelsville, both of Pa.

[73] Assignee: Minerals Technologies Inc., New York, N.Y.

[21] Appl. No.: 857,549

[22] Filed: May 16, 1997

[51] Int. Cl.[6] ..... B32B 5/16

[52] U.S. Cl. ..... 428/330; 428/340; 428/537.5

[58] Field of Search ..... 428/330, 331, 428/324, 327, 328, 212, 340, 537.5

[56] References Cited

U.S. PATENT DOCUMENTS

| | | | |
|---|---|---|---|
| 4,714,603 | 12/1987 | Vanderheiden | 423/432 |
| 5,007,964 | 4/1991 | Tsukisaka et al. | 106/464 |
| 5,120,365 | 6/1992 | Kogler | 106/415 |
| 5,478,388 | 12/1995 | Gane et al. | 106/415 |
| 5,676,746 | 10/1997 | Brown | 106/465 |
| 5,731,034 | 3/1998 | Husband | 427/288 |
| 5,759,347 | 6/1998 | Leube et al. | 162/135 |

FOREIGN PATENT DOCUMENTS 2139606 11/1984 United Kingdom .

*Primary Examiner*—H. Thi Le

*Attorney, Agent, or Firm*—Marvin J. Powell; Terry B. Morris

[57] ABSTRACT

The present invention relates to a paper coated with a coating pigment for rotogravure printing, and to a method for preparing such a paper. In addition, the invention relates to a method for the preparation of an aragonitic calcium carbonate pigment for coating paper that is useful in rotogravure printing. The present invention also relates to precipitated calcium carbonate particles having an aspect ratio of from about 3:1 to about 15:1, preferably from about 4:1 to about 7:1, and a multimodal particle size distribution, which is preferably bimodal or trimodal. Preferably, the aragonitic precipitated calcium carbonate is present in an amount from about 20 percent to about 100 percent by weight. Typically, the aragonitic precipitated calcium carbonate has a specific surface area of from about 4 $m^2/g$ to about 15 $m^2/g$, preferably from about 5 $m^2/g$ to about 7 $m^2/g$. Precipitated calcium carbonate pigments of the invention may also be used with titanium dioxide, talc, calcined clay, satin white, plastic pigments, aluminum trihydrate, mica, or mixtures thereof. Other useful additives include a synthetic latex binder, such as a styrene/butadiene or acrylic binder, a starch cobinder, a starch insolubilizer, such as a melamine/formaldehyde resin, and a calcium stearate lubricant.

16 Claims, 1 Drawing Sheet

ARAGONITIC PRECIPITATED CALCIUM CARBONATE PIGMENT FOR COATING ROTOGRAVURE PRINTING PAPERS

FIELD OF THE INVENTION

The present invention is directed to a precipitated calcium carbonate pigment that has been found to be useful in the production of high quality coated paper designed for use in rotogravure printing. The precipitated calcium carbonate is preferably aragonitic in nature, and displays a high length-to-width or aspect ratio and a multimodal particle size distribution. When used in coating formulations alone or in combination with clay, talc or clay/talc blends, the carbonate of the invention provides improvement in missing dot performance when compared to typical coating grade carbonates, and is particularly advantageous in the production of lightweight coated (LWC) rotogravure papers.

BACKGROUND OF INVENTION

At present, three methods are used extensively for the commercial application of printing ink to paper, i.e., offset, letterpress (and flexography), and gravure type printing. In offset printing, the printing plate has hydrophilic or "water-loving" non-printing areas and hydrophobic or "water-hating" printing areas, and is "planographic", i.e., the hydrophilic and hydrophobic areas of the plate all lie in the same plane, so that the plate has no relief. During printing, the printing plate does not come in direct contact with the paper to be printed, but rather transfers the inked image to a rubber blanket, which then applies the image to paper. Therefore, the process is an indirect, or offset method, and, hence, the name offset printing. The offset printing plate is initially wetted with an aqueous-based fountain solution that is preferentially adsorbed by the hydrophilic portion of the plate, and rejected by the hydrophobic portion. The plate is then contacted with a rubber roller laden with printing ink, which is rejected by the hydrophilic regions of the plate and accepted by the hydrophobic regions.

A significant advantage of offset printing is the ability to adequately print on relatively rough paper, due to the use of the rubber printing blanket, which is compressible, and, thus, allows intimate contact between the printing ink and the surface of the paper. Commonly used pigments in the coatings of paper used in offset printing include calcium carbonate and clay.

Letterpress and flexography are relief printing methods, in which the inked image portion of the plate is raised compared to the surrounding non-inked portion of the plate. Letterpress is typically a direct printing method, where the plate comes in direct contact with the paper. The high cost of the engravings required to produce the letterpress printing plate is a serious limitation of this process.

Gravure printing is an intaglio method, in which the image area contains recessed cells that are etched into a metallic printing plate to hold the printing ink. Ink is applied to the plate, filling the cells, where the amount of ink contained in each cell is determined by the depth of the cell. After the ink is applied to the gravure plate, the plate is wiped by a doctor blade that removes ink from the smooth, flat, non-image areas. In the most common form of gravure printing, a continuous roll or web of paper is printed, hence the name rotogravure. Although the cost of preparing a gravure printing plate or cylinder is much higher than preparing an offset printing plate, a rotogravure print run is typically very long, which offsets the cost of producing the gravure printing plate.

Since rotogravure is a direct printing method, the best results are obtained when the paper readily drains ink from the recessed cells without an excessive amount of pressure between the paper and the printing plate. Therefore, to obtain an acceptable rotogravure print, paper with the proper ink adsorption properties and good smoothness is required. A smooth and compressible paper is required to provide proper contact between the paper surface and the cell, so that each gravure cell in the printing plate is properly drained. Where contact between the paper surface and a cell is poor, the cell is not properly drained, resulting in a problem known as "missing dots". Therefore, the need for very smooth paper is a major limitation of rotogravure printing.

Good smoothness is typically achieved in paper for rotogravure printing by what is known in the art as "fiber coverage". In North American rotogravure formulations, fiber coverage is generally obtained by the use of large, platy clays, such as delaminated clay, to form a structure that bridges fibers in the paper. In Europe, talc is commonly used as an effective bridging pigment. Fiber coverage can also be enhanced with the use of structuring pigments, such as calcined clay, which improve the bulk of the coating, and can also improve compressibility.

Carbonates have rarely been used in rotogravure papers for a number of reasons, including high missing dots, increased roughness, and low gloss. In addition, most LWC rotogravure papers are still made by an acid papermaking process, and the carbonate, when used as a filler, will decompose in the acidic media used in the acid papermaking process. As a result, the acid papermaking process can tolerate only very small quantities of carbonate without experiencing serious processing problems. Therefore, even though calcium carbonate may be used as a coating pigment, where exposure to acidic conditions is limited, the teaching of the prior art has generally been that carbonates should not be used in rotogravure papers.

RELATED ART

U.K. Patent Application GB 2139606 discloses a calcium carbonate coating pigment that contains 50 to 70 percent by weight of particles smaller than 1 $\mu$m, less than 10 percent of the particles smaller than 0.2 $\mu$m, and a BET specific surface area of less than 10 $m^2/g$ for use as a high-solids coating pigment for gravure papers. The preferred particles are ground, and have a shape consistent with ground calcium carbonate.

However, U.S. Pat. No. 5,120,365 teaches that the calcium carbonate pigment disclosed in DE-OS P 33 16 949.7, the priority document for U.K. Patent Application GB 2139606, has not established itself in practice for use in rotogravure printing because the number of missing dots is too great, and the gloss of the paper is too low. U.S. Pat. No. 5,120,365 also teaches that typical rotogravure coatings clays, such as kaolin and "Superclay", an English kaolin, are very good for printability purposes, but have poor rheological behavior, higher binder requirements, can only be worked in low solids applications, and provide low gloss.

U.S. Pat. No. 5,120,365 discloses a pigment mixture that contains 40 to 80 percent by weight calcium carbonate and/or dolomite and 20 to 60 percent by weight talc, a talc-kaolin mixture, or a talc-mica mixture, where 50 to 80 percent by weight of the talc in the talc-kaolin or talc-mica mixture has a particle size distribution of 98 to 100 percent less than 20 $\mu$m, 25 to 70 percent less than 2 $\mu$m, 12 to 40 percent less than 1 $\mu$m, and 0.1 to 12 percent less than 0.2 $\mu$m, and a calcium carbonate or dolomite particle size distribution of 95 to 100 percent less than 10 μm, 60 to 98 percent less than 2 μm, 15 to 80 percent less than 1 μm, and 0.1 to 20 percent less than 0.2 μm, where the size of the particle corresponds to a spherical diameter. Fiber coverage is provided by increasing the application solids level of the carbonate-containing coating. Improved smoothness is a well-known effect of a higher solids application.

GB 2139606 and U.S. Pat. No. 5,120,365 also cite two publications that strongly advise against the use of calcium carbonate as a coating pigment for use in rotogravure papers:

1) Dr. Ken Beazley, *How Developments in Coating Pigments Affect Paper Printability,* ECC International, an in-house periodical, 1981, pages 1 and 2, states that ground calcium carbonate is a poorer coating pigment than kaolin clay for rotogravure papers, and stresses that calcium carbonate gives poor printability.

2) *Possibilities and Limitations of High Solids Colors,* 1979 TAPPI Coating Conference Proceedings, page 39, states that the print quality is poorer when using ground calcium carbonate than when using kaolin at the same or higher solids concentration.

U.S. Pat. No. 5,478,388 teaches in a first aspect a paper coating pigment, comprising (a) from 10 percent to 100 percent by weight of a first paper coating pigment having a particle size distribution such that at least 75 percent by weight of the particles have an equivalent spherical diameter smaller than 2 μm, and at least 60 percent have an equivalent spherical diameter smaller than 1 μm, where the average particle aspect ratio of the fraction having an equivalent spherical diameter predominately smaller than 1 μm is 25:1 or greater, preferably, 40:1 or greater, and (b) up to 90 percent by weight of a second coating pigment.

In a second aspect, U.S. Pat. No. 5,478,388 teaches a paper coating pigment having a particle size distribution such that at least 45 percent by weight of the particles have an equivalent spherical diameter smaller than 2 μm, and a distribution of particle aspect ratios such that if the pigment is subjected to a particle size separation to divide the pigment into a first fraction consisting of particles having an equivalent spherical diameter predominately larger than 1 μm and a second fraction having an equivalent spherical diameter predominately smaller than 1 μm, the average aspect ratio of each fraction is greater than 25:1.

In a third aspect, U.S. Pat. No. 5,478,388 teaches a method for enhancing the water retention and/or improving the high speed runnability of a paper coating composition, comprising the step of substantially increasing the average aspect ratio of the size fraction of the paper coating pigment smaller than 1 μm.

There still remains a need for improved coating grade calcium carbonate pigments for rotogravure printing paper.

SUMMARY OF THE INVENTION

The present invention relates to paper coated with a coating pigment which comprises aragonitic precipitated calcium carbonate (PCC) particles having an aspect ratio of from about 3:1 to about 15:1; preferably from about 4:1 to about 7:1, and a multimodal particle size distribution, which is preferably bimodal or trimodal. Preferably, the aragonitic precipitated calcium carbonate is present in an amount from about 20 to about 100 percent weight. The coated paper of the present invention is particularly useful in rotogravure printing.

The present invention also relates to a method for preparing the coated paper, which comprises preparing the aragonitic PCC pigment and applying the pigment to the paper basestock.

The modality of the particle size distribution of the aragonitic PCC is such that from about 0 (zero) percent to about 25 percent of the particles have an equivalent spherical diameter of less than about 0.4 μm, from about 40 percent to about 60 percent of the particles have an equivalent spherical diameter of from about 0.4 μm to about 1.0 μm, from about 10 percent to about 35 percent of the particles have an equivalent spherical diameter of from about 1 μm to about 3 μm, and from about 0 (zero) percent to about 20 percent of the particles have an equivalent spherical diameter of from about 3 μm to about 10 μm. Preferably, the modality is such that from about 5 percent to about 15 percent of the particles have an equivalent spherical diameter of less than about 0.4 μm, from about 45 percent to about 55 percent of the particles have an equivalent spherical diameter of from about 0.4 μm to about 1.0 μm, from about 25 percent to about 35 percent of the particles have an equivalent spherical diameter of from about 1 μm to about 3 μm, and from about 5 percent to 10 percent of the particles have an equivalent spherical diameter of from about 3 μm to about 10 μm. Another preferable modality is one in which from about 15 percent to about 25 percent of the particles have an equivalent spherical diameter of less than about 0.4 μm, from about 55 percent to about 65 percent of the particles have an average equivalent spherical diameter of from about 0.4 μm to about 1 μm. From about 10 percent to about 20 percent of the particles have an equivalent spherical diameter of from about 1 μm to about 3 μm, and from about 0 (zero) percent to about 10 percent of the particles have an equivalent spherical diameter of from about 3 μm to about 10 μm.

Typically, the precipitated calcium carbonate has a specific surface area of from about 4 $m^2/g$ to about 15 $m^2/g$, and an overall particle size distribution such that substantially all of the particles, i.e., about 100 percent, have an equivalent spherical diameter of less than about 15 μm, from about 70 percent to about 95 percent of the particles have an equivalent spherical diameter of less than about 2 μm, from about 50 percent to about 85 percent of the particles have an equivalent spherical diameter of less than about 1 μm, and less than 35 percent of the particles have an equivalent spherical diameter of less than about 0.4 μm. Preferably, the precipitated calcium carbonate has a specific surface area of from about 5 $m^2/g$ to about 7 $m^2/g$, and an overall particle size distribution such that substantially all of the particles have an equivalent spherical diameter of less than about 8 μm, from about 75 percent to 85 percent of the particles have an equivalent spherical diameter of less than about 2 μm, from about 55 percent to 80 percent of the particles have an equivalent spherical diameter of less than about 1 μm, and less than about 15 percent of the particles have an equivalent spherical diameter of less than about 0.4 μm. Another preferable precipitated calcium carbonate is one which has a specific surface area of from about 6 $m^2/g$ to about 8 μm and an overall particle size distribution such that substantially all of the particles have an average equivalent spherical diameter of less than about 8 μm, from about 85 percent to about 95 percent of the particles have an equivalent spherical diameter of less about 2 μm, from about 75 percent to 85 percent of the particles have an equivalent spherical diameter of less than about 1 μm, and less than about 25 percent of the particles have an equivalent spherical diameter of less than about 0.4 μm.

Precipitated calcium carbonate pigments of the invention may also be used with titanium oxide, talc, calcined clay, satin white, plastic pigments, aluminum trihydrate, mica, or mixtures thereof. Other useful additives include from about 5 percent to about 10 percent by weight of a synthetic latex binder, such as a styrene/butadiene or acrylic binder, from about 2 percent to about 5 percent of a starch cobinder, from about 0.1 percent to about 1.5 percent of thickener such as carboxymethyl cellulose, hydroxymethyl cellulose, or polyacrylates, up to about 0.5 percent by weight of a starch insolubilizer, such as a melamine/formaldehyde resin, and from about 0.5 percent to about 1.5 percent by weight of a calcium stearate lubricant.

DETAILED DESCRIPTION OF THE INVENTION

Figure 1:
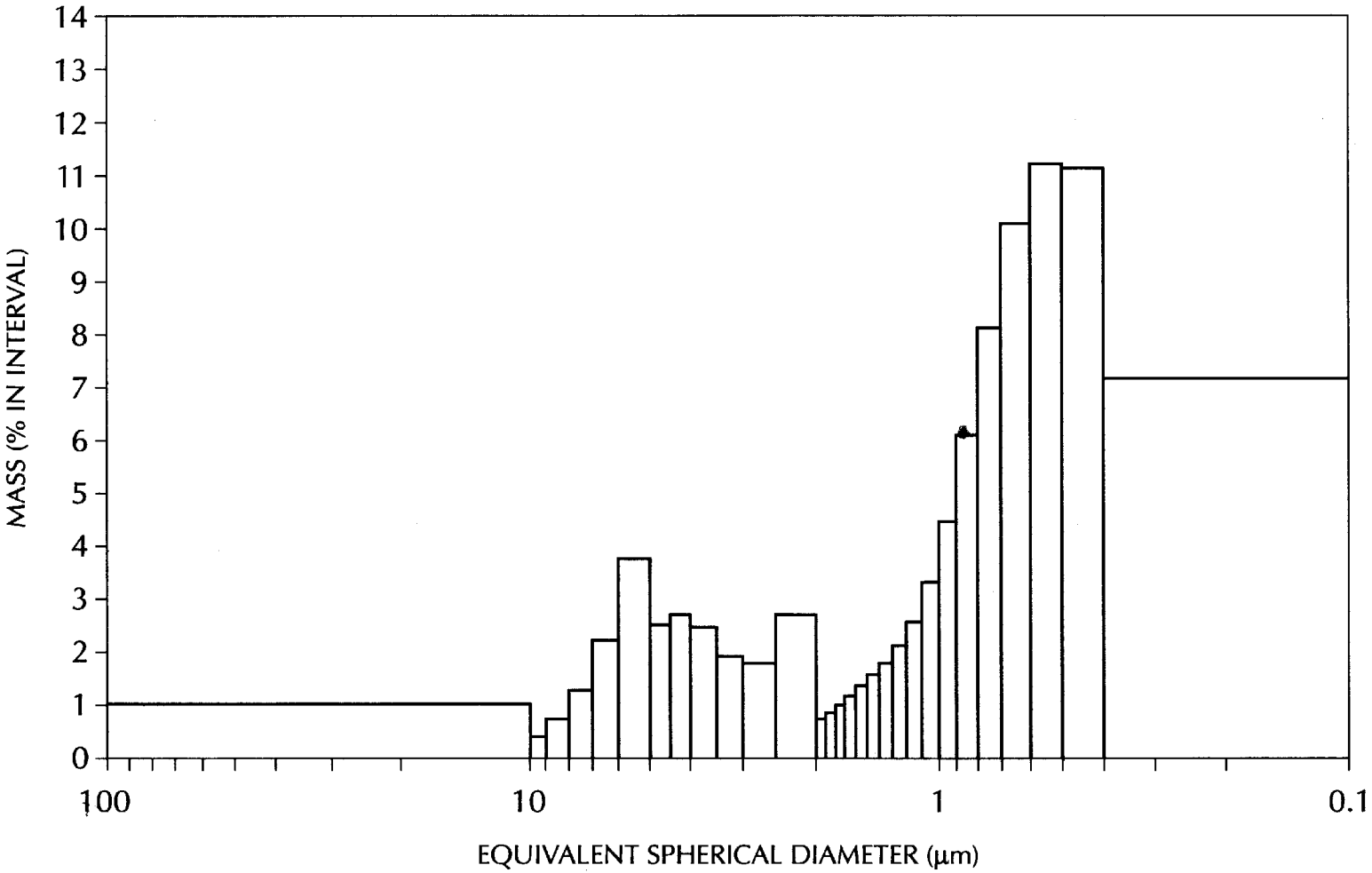
FIG. 1 is a graph of mass population v. diameter, showing the multimodal size distribution of the particles of an aragonitic precipitated calcium carbonate for use in the coating pigment of the invention.

Unless otherwise specified, all reference to parts or percent herein refer to percent by weight.

The present invention is directed to a high quality coated paper for rotogravure printing. The calcium carbonate is preferably aragonitic, i.e., the orthorhombic form of crystalline calcium carbonate, and displays a high length-to-width or aspect ratio of from about 3:1 to about 15:1, preferably from about 4:1 to about 7:1, and a multimodal particle size distribution. Although, aragonitic precipitated calcium carbonates having a bimodal particle size distribution are useful in the coating pigments of the invention, the particle size distribution is preferably at least bimodal or trimodal. When used in pigment formulations alone or in combination with clay, talc or blends of clay and talc, the precipitated calcium carbonate pigment of the invention provides improvement in missing dot performance, when compared to typical prior art coating grade carbonates, and is particularly advantageous in the production of lightweight coated (LWC) rotogravure papers.

The unique combination of the aragonitic particle shape and multimodal particle size distribution of the aragonitic precipitated calcium carbonate pigment of the invention provides fiber coverage and associated rotogravure printability. Although a narrow particle size distribution may provide good fiber coverage, as determined by smoothness measurements, a series of tests have unexpectedly shown that a narrow particle size distribution alone is not sufficient to optimize missing dot performance. The aragonitic precipitated calcium carbonate pigment of the present invention provides missing dot performance because the unique multimodal distribution of the pigments provides coating bulk, compressibility, and smoothness, while the high aspect ratio provides bridging of fibers leading to increased levelness and smoothness. These factors combine to result in improved missing dot performance, meeting or exceeding the performance of typical clay- and talc-based rotogravure formulations.

In addition, the precipitated calcium carbonate pigment of the present invention has other clear advantages over clay, talc, and typical ground and non-aragonitic precipitated calcium carbonate rotogravure pigments in formulation, application, finishing, physical properties, and printability.

During formulation, the aragonitic precipitated calcium carbonate pigment of the present invention provides for easier makedown, including co-dispersion with dry talc, a lowering of Brookfield and/or Hercules viscosity, the production of higher solids coatings, and more efficient drying. Application of the coating is improved as a result of lower coating viscosities, which allow the application of higher solids coatings. The improved opacity which results from such coatings allows the elimination of calcined clay from the formulation, thereby improving blade cleanliness.

For finishing, the precipitated calcium carbonate pigment of the present invention provides for improved opacity, allowing the reduction or elimination of titanium dioxide, $TiO_2$, in the coating. Titanium dioxide, a common ingredient in coating formulations, is a particularly difficult pigment to "glue-down" due to its small size. The poor adhesion of $TiO_2$ with the low levels of binder used in rotogravure grades can result in $TiO_2$ "milking" on the supercalender. In addition, supercalender speed may be increased or the pressure may be decreased with the pigment of the invention due to a glossability that is superior to ground calcium carbonate.

Improvements in paper properties include increased opacity due to the generation of an open coating structure that can efficiently scatter light and increased brightness due both to an inherently higher brightness in the material and increased light scattering. The improved optical performance allows for the reduction or elimination of calcined clay, $TiO_2$ and/or optical brighteners, resulting in a reduction in the cost of the coating.

The papers coated with the pigment of the invention provide improved missing dot performance, the ability to control coating structure pore size by choice of particle size for optimum printing performance, increased porosity, and, when the aragonitic precipitated calcium carbonate pigment of the invention is blended with talc, the ability to control the papers' coefficient of friction to provide fuller, usage of paper on large rotogravure reels.

Improved coating results are obtained with the aragonitic precipitated calcium carbonate pigment of the invention, either alone or in blends with clay and/or talc. The precipitated calcium carbonate content of the pigment can range from about 20 percent to about 100 percent of the coating formulation. Other pigments such as $TiO_2$, calcined clay, satin white, plastic pigments, aluminum trihydrate, mica or other typical inorganic pigments can be utilized at lower levels to impart particular qualities to the coated paper, such as brightness or opacity.

The pigment mixture of the invention is particularly advantageous for use in rotogravure printing papers, and may additionally contain from about 5 percent to about 10 percent by weight (dry basis, based on 100 parts dry inorganic pigment) of a synthetic latex binder, preferably of the styrene/butadiene or acrylic type, which may also contain starch as a co-binder in the range of from about 2 percent to about 5 percent.

Typically, the pigment mixture additionally contains from about 0.5 percent to about 1.5 percent calcium stearate as a lubricant. Starch-containing formulations may also contain up to about 0.5 percent of a starch insolubilizer, such as a melamine/formaldehyde resin or other typical insolubilizer. The coating can also contain dilution water in an amount needed to bring the final moisture content of the coatings to a range of from about 50 percent to about 65 percent. The coating may also contain from about 0.1 percent to about 1.5 percent of thickener such as carboxymethyl cellulose, hydroxyethyl cellulose, or polyacrylates.

To prepare the aragonitic precipitated calcium carbonate of the invention, a milk of lime ($Ca(OH)_2$) slurry or slake is prepared by adding water to calcium oxide (CaO) with agitation. Preferably, about ten parts water having a temperature of at least about 40° C. (Centigrade) is added to one part CaO to produce a slake having a solids content of about 11 percent, based on the weight of $Ca(OH)_2$ in the solution. The slake is screened to remove grit, typically with a screen that will remove grit of about +60 mesh, and the slake temperature is adjusted to about 50° C. Dry aragonite, such as M60 Aragonite from the Mississippi Lime Company, located in St. Genevieve, Mo., is added, and the slake is agitated for about 15 minutes. Preferably, the amount of aragonite added is equivalent to about five percent of the total amount of precipitated calcium carbonate that will be produced from the slake. Carbon dioxide gas is then added with vigorous agitation. The gas stream rate should be sufficient to convert substantially all of the $Ca(OH)_2$ to $CaCO_3$ in about three hours, forming a precipitated calcium carbonate slurry of about 14 percent solids. Carbonation is complete when the pH falls to 7, at which time the carbon dioxide ($CO_2$) stream is terminated. Typically, between about 9 $ft^3$ and 10 $ft^3$ of $CO_2$ are required for each kilogram of precipitated calcium carbonate produced. The product can then be dewatered to a concentration of about 70 percent solids to produce a cake that can be treated with a typical dispersant, e.g., sodium polyacrylate, and dispersed on a flat-blade or similar dispersion unit.

Data from a Sedigraph of a sample of the aragonitic precipitated calcium carbonate of the invention are shown graphically in FIG. 1 in which the mass percent of particles within a given size interval is plotted against equivalent spherical diameter. The multimodal particle size distribution is clearly seen in the three substantially distinct peaks on the graph, which are centered at about 0.6 μm, about 2 μm, and at about 5 μm with the majority of the particles in the range of about 0.6 μm. The modality of the particle size distribution of the precipitated calcium carbonate measured to obtain the data in FIG. 1 is such that about 7.3 percent of the particles have an equivalent spherical diameter of less than about 0.4 μm, 51.4 percent of the particles have an equivalent spherical diameter of about 0.4 μm to about 1.0 μm, 21.8 percent of the particles have an equivalent spherical diameter of about 1 μm to about 3 μm, and 18.5 percent of the particles have an equivalent spherical diameter of from about 3 μm to about 10 μm. Generally, the modality of the particle size distribution of a precipitated calcium carbonate of the invention is such that from about 0 (zero) percent to about 25 percent, preferably from about 5 percent to about 15 percent, of the particles have an equivalent spherical diameter of less than about 0.4 μm, from about 40 percent to about 60 percent, preferably from about 45 percent to about 55 percent, of the particles have an equivalent spherical diameter of from about 0.4 μm to about 1.0 μm, from about 15 percent to about 35 percent, preferably from about 25 percent to about 35 percent, of the particles have an equivalent spherical diameter of from about 1 μm to about 3 μm, and from about 0 (zero)percent to about 20 percent, preferably from about 5 percent to 10 percent, of the particles have an equivalent spherical diameter of from about 3 μm to about 10 μm. Another preferable modality is one in which from about 15 percent to about 25 percent of the particles have an equivalent spherical diameter of less than about 0.4 μm, from about 55 percent to about 65 percent of the particles have an average equivalent spherical diameter of from about 0.4 μm, to about 1 μm. From about 10 percent to about 20 percent of the particles have an equivalent spherical diameter of from about 1 μm to about 3 μm, and from about 0 (zero) percent to about 10 percent of the particles have an equivalent spherical diameter of from about 3 μm to about 10 μm.

The overall particle size distribution of the aragonitic precipitated calcium carbonate useful in the pigment of the invention, as measured with a sedimentation technique, is such that substantially all of the particles have an equivalent spherical diameter of less than about 15 μm, from about 70 percent to about 95 percent of the particles have an equivalent spherical diameter of less than about 2 μm, from about 50 percent to about 85 percent of the particles have an equivalent spherical diameter of less than about 1 μm, and less than 35 percent of the particles have an equivalent spherical diameter of less than about 0.4 μm. Preferably, the overall particle size distribution of the aragonitic precipitated calcium carbonate is such that substantially all of the particles have an equivalent spherical diameter of less than about 8 μm, from about 75 percent to 85 percent of the particles have an equivalent spherical diameter of less than about 2 μm, from about 55 percent to 80 percent of the particles have an equivalent spherical diameter of less than about 1 μm, and less than about 15 percent of the particles have an equivalent spherical diameter of less than about 0.4 μm. Another preferable precipitated calcium carbonate is one which has a specific surface area of from about 6 $m^2/g$ to about 8 $m^2/g$ and an overall particle size distribution such that substantially all of the particles have an average equivalent spherical diameter of less than about 8 μm, from about 85 percent to about 95 percent of the particles have an equivalent spherical diameter of less about 2 μm, from about 75 percent to 85 percent of the particles have an equivalent spherical diameter of less than about 1 μm, and less than about 25 percent of the particles have an equivalent spherical diameter of less than about 0.4 μm.

Typically, the aspect ratio of the precipitated calcium carbonate particles ranges from about 3:1 to about 15:1, preferably from about 4:1 to about 7:1, and the specific surface area ranges from about 4 $m^2/g$ to about 15 μm, preferably from about 5 $m^2/g$ to about 7 $m^2/g$.

EXAMPLES

The following non-limiting examples are merely illustrative of the preferred embodiments of the present invention, and are not to be construed as limiting the invention, he scope of which is defined by the appended claims.

In the following examples, the aragonitic precipitated alcium carbonate of the invention is produced from a milk of lime ($Ca(OH)_2$) slurry (slake) prepared by adding water to calcium oxide (CaO) using mechanical agitation. Preferably, about ten parts water having a temperature of at least 40° C. (Centigrade) is added to one part CaO to produce a slake having a solids content of about 11 percent based on the weight of the $Ca(OH)_2$ in the slurry. The slake is screened to remove grit, typically with a screen that will remove grit of about +60 mesh, and the slake temperature is adjusted to about 50° C. Dry aragonite, such as M60 Aragonite from the Mississippi Lime Company, located in St. Genevieve, Mo., is then added, and the slake is stirred for about 15 minutes. Preferably, the amount of aragonite added is equivalent to about five percent of the total amount of precipitated calcium carbonate that will be produced from the slake. Carbon dioxide ($CO_2$) gas is then introduced into the slake while vigorously agitating the mixture. The $CO_2$ rate should be sufficient to convert substantially all of the $Ca(OH)_2$ to $CaO_3$ in about three hours, forming a precipitated calcium carbonate slurry of about 14 percent solids. Carbonation is complete when the pH falls to 7, at which time the $CO_2$ introduction is terminated. Typically, between about 9 $ft^3$ and 10 $ft^3$ of $CO_2$ are required for each kilogram of precipitated calcium carbonate produced. The product is then dewatered to a concentration of about 70 percent solids to produce a cake that can be treated which a typical dispersant, e.g., sodium polyacrylate and is then dispersed on a flat-blade or similar dispersion unit.

Example 1

A typical clay control containing 90 parts of delaminated clay and 10 parts of calcined clay was prepared using a binder containing 7 parts styrene/butadiene latex, 3 parts hydroxyethylated starch, and 1 part calcium stearate lubricant. In the experimental formulations, 30 parts of a precipitated calcium carbonate were used to replace all of the calcined clay and 20 parts of delaminated clay of a typical coating pigment mixture. Each precipitated calcium carbonate pigment formulation contained the same binder. PCC-1 differs from PCC-2 and PCC-3 in that it exhibits a multimodal particle size distribution and high aspect ratio that are not found in PCC-2 and PCC-3. PCC-2 and PCC-3 are precipitated calcium carbonates, that are more blocky in particle shape and have narrower particle size distributions than the aragonitic precipitated calcium carbonate of the invention.

PCC-2 is an aragonitic precipitated calcium carbonate that has a unimodal size distribution, an aspect ratio of from about 1:1 to about 2:1, and an average particle size of about 0.4 $\mu$m. PCC-3 is a precipitated calcite that is blocky in nature, has a unimodal particle size distribution and an aspect ratio of from about 1:1 to about 2:1. In contrast, PCC-1 is an aragonitic precipitated calcium carbonate pigment according to the invention, having a trimodal particle size distribution similar to that shown in FIG. 1 and an aspect ratio of from about 4:1 to about 7:1.

Pigment coatings were formulated at approximately 60 percent solids, and tested for percent solids and water retention character as determined by the AA-GWR method (Kaltec Scientific, USA). Scattering coefficients were obtained by drawing a coating film down over an impervious, smooth black glass background, and measuring the coat weight and reflectance of the film at 580 nanometers. Low shear viscosities in centipoise were measured at 10, 20, 50 and 100 revolutions per minute (rpm) using a Brookfield model RVT viscometer. High shear viscosity measurements were made using a Hercules high shear viscometer from Kaltec Scientific, USA. The Hercules viscosities were run using the following conditions: E bob, 400,000 dyne-cm/cm spring constant, 0–4400 rpm, room temperature. The formulation data for the coatings are provided in Table 1.

TABLE 1

| | Clay Control | PCC-1* | PCC-2 | PCC-3 |
|---|---|---|---|---|
| percent solids: | 60.0 | 58.6 | 60.4 | 60.0 |
| AA-GWR: ($m^2$/g) | 116 | 157 | 111 | 130 |
| Scattering coefficient ($cm^2$/g) | 912 | 1015 | 764 | 941 |
| Brookfield viscosity | | | | |
| 10: | 4180 | 1340 | 1980 | 2280 |
| 20: | 2430 | 840 | 1160 | 1370 |
| 50: | 1236 | 462 | 612 | 720 |
| 100: | 796 | 292 | 390 | 468 |
| Hercules viscosity: (cps) | 49.3 | 35.4 | 34.0 | 31.9 |

* - Aragonitic precipitated calcium carbonate according to the invention.

The pigment coatings described above were applied to a 27 pounds per ream (40 g/$m^2$), groundwood-containing LWC basestock at a speed of 2200 ft/min (700 m/min.) using a Cylindrical Laboratory Coater (CLC-6000) . The coat weight target was 4 pounds per ream (6 g/$m^2$). Coated sheets were supercalendered 2 nips at 1050 pounds per linear foot (705 kg/m) and 150° F. (65.5° C.) in order to impart a sheet gloss of approximately 55 points to the clay control.

The rotogravure printability of the coated papers was evaluated using a Heliotest missing dot method on an IGT print tester. Standard testing of the coated sheets included paper gloss, print gloss, brightness and opacity. The results of these tests are summarized in Table 2.

TABLE 2

| | Clay Control | PCC-1* | PCC-2 | PCC-3 |
|---|---|---|---|---|
| Heliotest: (# of missing dots) | 69 | 52 | 62 | 59 |
| Print gloss: | 75 | 74 | 76 | 76 |
| 75° Sheet gloss: | 51 | 52 | 56 | 55 |
| Brightness: | 69.4 | 70.0 | 70.0 | 70.1 |
| Opacity: | 81.9 | 81.7 | 81.2 | 81.4 |
| PPS-10 roughness: | 1.74 | 1.58 | 1.74 | 1.76 |

* - Aragonitic precipitated calcium carbonate pigment according to the invention.

The results of Example 1 demonstrate that the aragonitic precipitated calcium carbonate pigment of the invention provides excellent Theological properties in the coating color. Tests of the coated sheets indicate that optical properties, such as brightness, opacity and sheet gloss, obtained with precipitated calcium carbonate pigments are equivalent to those obtained with clay. However, the pigment of the invention additionally provides improved smoothness and rotogravure printability when compared to both the clay control and the non-aragonitic precipitated calcium carbonates. As an additional benefit, the use of the aragonitic precipitated calcium carbonate in the coating allows for the removal of 10 parts of calcined clay, a significant cost savings.

Example 2

The performance of PCC-1 was again compared to a clay control similar to that used in Example 1. In this case, the control and experimental formulations contained 5 parts $TiO_2$ for enhancement of opacity and brightness.

In each experimental formulation, 30 parts of the precipitated calcium carbonate pigment was used, and the calcined clay was eliminated. The precipitated calcium carbonate pigments were used in systems that typically contained delaminated clay, and were also used in systems that contained a coating grade talc that has been developed for the production of rotogravure printing papers. The pigment formulations are given in Table 3.

TABLE 3

| | 1 | 2 | 3* | 4 | 5 | 6* | 7 |
|---|---|---|---|---|---|---|---|
| Delaminated clay | 85 | 35 | 35 | 35 | 65 | 65 | 65 |
| Calcined clay | 10 | — | — | — | — | — | — |
| Montana talc | — | 30 | 30 | 30 | — | — | — |
| PCC-1 | — | — | 30 | — | — | 30 | — |
| PCC-2 | — | 30 | — | — | 30 | — | — |
| PCC-3 | — | — | — | 30 | — | — | 30 |
| $TiO_2$ | 5 | 5 | 5 | 5 | 5 | 5 | 5 |

* - Aragonitic precipitated calcium carbonate pigment according to the present invention.

The delaminated and calcined clays were received as dry powders. In preparing the pigment formulations, the delaminated clay was dispersed at 70 percent solids, and the calcined clay was dispersed at 50 percent solids using a conventional flat-blade (Cowles-type) mixer. The coating grade talc was dispersed on a Cowles mixer by directly adding dry talc to the precipitated calcium carbonate slurries at a 1:1 ratio at a solids level ranging from 70 to 77 percent, using 2 percent of a non-ionic EO/PO surfactant and 0.2 percent of a sodium polyacrylate dispersant.

The binder used was 7 parts styrene/butadiene latex and 3 parts hydroxyethylated starch. A hydroxyethyl cellulose thickener was used at the 0.1 part level for viscosity adjustment. Coatings were prepared at the highest possible solids level, and then diluted to approximately match the Hercules viscosity of the control. Coating formulation data for the pigments tested are given in Table 4.

TABLE 4

| | 1 | 2 | 3* | 4 | 5 | 6* | 7 |
|---|---|---|---|---|---|---|---|
| percent solids: | 60.0 | 66.0 | 63.0 | 64.1 | 65.2 | 63.3 | 64.0 |
| AA-GWR ($m^2/g$): | 112 | 65 | 93 | 76 | 90 | 120 | 102 |
| Scattering coefficient ($cm^2/g$): | 1204 | 1020 | 1082 | 1054 | 1036 | 1107 | 1158 |
| Brookfield viscosity | | | | | | | |
| 10: | 2460 | 4220 | 2400 | 3100 | 5560 | 3240 | 3900 |
| 20: | 1470 | 2840 | 1500 | 1940 | 3320 | 1980 | 2400 |
| 50: | 812 | 1556 | 840 | 1084 | 1740 | 1076 | 1260 |
| 100: | 526 | 1020 | 570 | 724 | 1108 | 712 | 820 |
| Hercules viscosity: (cps) | 50.0 | 51.4 | 57.0 | 54.9 | 52.1 | 50.0 | 54.9 |

* - Aragonitic precipitated calcium carbonate pigment according to the present invention.

After preparation, the coatings were applied to a 27 pounds per ream (40 $g/m^2$) groundwood-containing LWC basestock at a speed of 2200 ft/min (700 m/min.) using a Cylindrical Laboratory Coater (CLC-6000). The coat weight target was 4 pounds per ream (6 $g/m^2$). Calendering conditions for the coated sheets were set to achieve a sheet gloss of approximately 50 points, the same as the clay control.

The rotogravure printability of the coated papers was evaluated using a Heliotest missing dot method on an IGT print tester. Standard testing of the coated sheets included paper gloss, print gloss, brightness and opacity. The coated sheet test data are given in Table 5.

TABLE 5

| | 1 | 2 | 3* | 4 | 5 | 6* | 7 |
|---|---|---|---|---|---|---|---|
| Heliotest printability: (Distance to 20th dot) | 45 | 33 | 50 | 46 | 34 | 52 | 30 |
| 75° Sheet gloss: | 49 | 46 | 45 | 48 | 51 | 46 | 48 |
| Brightness: | 71.5 | 71.2 | 71.5 | 71.5 | 71.6 | 71.9 | 71.8 |
| Opacity: | 85.8 | 85.2 | 85.6 | 85.2 | 85.3 | 85.8 | 85.8 |
| PPS-20 roughnness | 0.93 | 0.93 | 0.88 | 0.86 | 0.92 | 0.86 | 0.91 |

* - Aragonitic precipitated calcium carbonate pigment according to the present invention.

As with Example 1, these data demonstrate the improved rotogravure printability that is provided by the coating pigment of the invention, and also demonstrates that the aragonitic precipitated calcium carbonate coating pigment can also be used in combination with talc and $TiO_2$ to produce sheets of superior performance in rotogravure printability.

Example 3

The performance of a formulation containing PCC-1 in combination with talc or coating clay was compared to that of PCC-3 with clay and to that of ground calcium carbonate (GCC) with clay. GCC is a natural ground calcite having a broad, unimodal size distribution and an aspect ratio of from about 1:1 to about 2:1. The clay used in each formulation was DB Plate delaminated clay, and the talc was Finntalc C-10, a commercially available coating grade talc from Finland. The delaminated clay and talc were each received as dispersed slurries, approximately 70 percent solids for the delaminated clay and approximately 65 percent solids for the talc. Pigment formulations for Example 3 are given in Table 6.

TABLE 6

| | 1* | 2 | 3* | 4 |
|---|---|---|---|---|
| Carbonate | PCC-1 | GCC | PCC-1 | PCC-3 |
| Delaminated Clay | — | 50 | 50 | 50 |
| Finnish Talc | 30 | — | — | — |
| PCC-1 | 70 | — | 50 | — |
| PCC-3 | — | — | — | 50 |
| GCC | — | 50 | — | — |

* - Aragonitic precipitated calcium carbonate pigment according to the present invention.

Coatings were prepared at about 61.5 percent solids, and included a binder containing 6 parts styrene/butadiene latex. Coating formulation data are given in Table 7.

TABLE 7

| | 1* | 2 | 3* | 4 |
|---|---|---|---|---|
| Carbonate | PCC-1 | GCC | PCC-1 | PCC-3 |
| Percent solids | 61.3 | 61.3 | 61.3 | 61.3 |
| 100 rpm Brookfield viscosity | 576 | 690 | 610 | 484 |
| Haake viscosity (cps) | 28.0 | 30.4 | 44. 1 | 29.8 |

* - Aragonitic precipitated calcium carbonate pigment according to the present invention.

Coatings were applied to a 27 pounds per ream (40 $g/m^2$) groundwood LWC basestock at a speed of 4000 ft/min (1200 m/min) using a pilot coater. A coat weight of approximately 6.8 pounds per ream (10 $g/m^2$) was applied to the wire side, and paper samples were prepared with a felt side coating having coat weights of 5.4, 6.8, and 8.1 pounds per ream (8, 10, and 12 $g/m^2$) . The rotogravure printability of the coated papers was evaluated using a Heliotest missing dot method on an IGT print tester. Standard tests of the coated sheets included paper gloss, print gloss, brightness, and opacity. Data obtained for the properties of the coated sheets were plotted graphically, and data were interpolated at a coat weight of 6.8 pounds per ream from best-fit plots. The results are given in Table 8.

TABLE 8

| | 1* | 2 | 3* | 4 |
|---|---|---|---|---|
| Carbonate | PCC-1 | GCC | PCC-1 | PCC-3 |
| Heliotest printability (distance to 20th dot) | 39 | 23 | 36 | 25 |
| 75° Sheet gloss | 53 | 53 | 58 | 57 |
| Brightness | 79.2 | 77.1 | 78.6 | 78.9 |
| Opacity | 90.7 | 89.6 | 91.0 | 91.1 |
| PPS-5 Roughness | 1.42 | 1.58 | 1.45 | 1.52 |

* - Aragonitic precipitated calcium carbonate pigment according to the present invention.

The results demonstrate that the aragonitic precipitated calcium carbonate coated pigment of the invention has superior printability and smoothness, when compared to a ground calcium carbonate pigment.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

We claim:

1. A composition comprising a coated paper with a pigment, said pigment comprises aragonitic precipitated calcium carbonate particles having an aspect ratio of from about 3:1 to about 15:1 and a multimodal particle size distribution.

2. The composition according to claim 1 wherein the aragonitic precipitated calcium carbonate has a modality of from about 0 (zero) percent to about 25 percent of the particles have an equivalent spherical diameter of less than about 0.4 μm, from about 40 percent to about 60 percent of the particles have an equivalent spherical diameter of from about 0.4 μm to about 1.0 μm, from about 10 percent to about 35 percent of the particles have an equivalent spherical diameter of from about 1 μm to about 3 μm, and from about 0 (zero) percent to about 20 percent of the particles have an equivalent spherical diameter of from about 3 μm to about 10 μm.

3. The composition according to claim 1 wherein the aragonitic precipitated calcium carbonate pigment has a modality of from about 5 percent to about 15 percent of the particles have an equivalent spherical diameter of less than about 0.4 μm, from about 45 percent to about 55 percent of the particles have an equivalent spherical diameter of from about 0.4 μm to about 1.0 μm, from about 25 percent to about 35 percent of the particles have an equivalent spherical diameter of from about 1 μm to about 3 μm, and from about 5 percent to about 10 percent of the articles have an equivalent spherical diameter of from about 3 μm to about 10 μm.

4. The composition according to claim 1, wherein the aragonitic precipitated calcium carbonate pigment has a modality of from about 15 percent to about 25 percent of the particles have an equivalent spherical diameter of less than about 0.4 μm, from about 55 percent to about 65 percent of the particles have an equivalent spherical diameter of from about 0.4 μm to about 1.0 μm, from about 10 percent to about 20 percent of the particles have an equivalent spherical diameter of from about 1.0 μm to about 3.0 μm, and from about 0 (zero) percent to about 10 percent of the particles have an equivalent spherical diameter of from about 3 μm to about 10 μm.

5. The composition according to claim 1 wherein the aragonitic calcium carbonate has an aspect ratio of from about 4:1 to about 7:1.

6. The composition according to claim 1 wherein the aragonitic precipitated calcium carbonate has a specific surface area of from about 4 $m^2/g$ to about 15 $m^2/g$, and an overall particle size distribution, less than about 15 μm, from about 70 percent to about 95 percent of the particles have an equivalent spherical diameter of less than about 2 μm, from about 50 percent to about 85 percent of the particles have an equivalent spherical diameter of less than about 1 μm, and less than 35 percent of the particles have an equivalent spherical diameter of less than about 0.4 μm.

7. The composition according to claim 1 wherein the aragonitic precipitated calcium carbonate has a specific surface area of from about 5 $m^2/g$ to about 7 $m^2/g$, and an overall particle size distribution of less than about 8 μm, from about 75 percent to 85 percent of the particles have an equivalent spherical diameter of less than about 2 μm, from about 55 percent to 80 percent of the particles have an equivalent spherical diameter of less than about 1 μm, and less than about 15 percent of the particles have an equivalent spherical diameter of less than about 0.4 μm.

8. The composition according to claim 1, wherein the aragonitic precipitated calcium carbonate has a specific surface area of from about 6 $m^2/g$ to about 8 $m^2/g$, and an overall particle size distribution such that substantially all of the particles have an equivalent spherical diameter of less than about 8 μm, from about 85 percent to 95 percent of the particles have an equivalent spherical diameter of less than about 2 μm, from about 75 percent to about 85 percent of the particles have an equivalent spherical diameter less than about 1 μm, and less than about 25 percent have an equivalent spherical diameter of less than about 0.4 μm.

9. The composition according to claim 1 wherein the aragonitic precipitated calcium carbonate is present in an amount from about 20 percent to about 100 percent by weight.

10. The composition according to claim 9 further comprising titanium dioxide, talc, calcined clay, satin white, plastic pigments, aluminum trihydrate, mica, or mixtures thereof.

11. The composition for rotogravure printing according to claim 1 further comprising from about 5 percent to about 10 percent by weight of a synthetic latex binder.

12. The composition according to claim 11 wherein the synthetic latex binder is a styrene/butadiene or acrylic binder.

13. The composition according to claim 11, further comprising from about 2 percent to about 5 percent of a starch co-binder.

14. The composition according to claim 13, further comprising up to about 0.5 percent by weight of a starch insolubilizer.

15. The composition according to claim 14, wherein the starch insolubilizer is a melamine/formaldehyde resin.

16. The composition according to claim 1, further comprising from about 0.5 percent to about 1.5 percent by weight of a calcium stearate lubricant.

* * * * *